US011350799B2

(12) United States Patent
Yang et al.

(10) Patent No.: US 11,350,799 B2
(45) Date of Patent: Jun. 7, 2022

(54) TOWEL DRYER

(71) Applicant: SHENZHEN ANTOP TECHNOLOGY CO., LTD, Shenzhen (CN)

(72) Inventors: Ruidian Yang, Shenzhen (CN); Weixin Ni, Shenzhen (CN)

(73) Assignee: SHENZHEN ANTOP TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 17/121,914

(22) Filed: Dec. 15, 2020

(65) Prior Publication Data

US 2022/0095854 A1 Mar. 31, 2022

(30) Foreign Application Priority Data

Sep. 25, 2020 (CN) ..... 202022150353.3

(51) Int. Cl.
*A47K 10/06* (2006.01)
*A47K 10/48* (2006.01)
*F28D 21/00* (2006.01)

(52) U.S. Cl.
CPC ..... *A47K 10/06* (2013.01); *A47K 10/48* (2013.01); *F28D 2021/0036* (2013.01)

(58) Field of Classification Search
CPC .. A47K 10/06; A47K 10/48; F24D 2021/0036
USPC ..... 34/621
See application file for complete search history.

(56) References Cited

U.S. PATENT DOCUMENTS 3,672,188 A * 6/1972 Geschka ..... D06F 18/00 68/12.15
5,642,462 A * 6/1997 Huff ..... A47K 10/06 211/105.1
8,143,553 B2 * 3/2012 DeFranco ..... A47K 10/06 219/201
10,006,711 B2 * 6/2018 Gammack ..... F26B 21/003
10,961,655 B2 * 3/2021 Hinkey ..... F26B 21/001
2006/0179676 A1 * 8/2006 Goldberg ..... D06F 58/206 34/77
2008/0253754 A1 * 10/2008 Rubin ..... B01D 46/10 392/381

(Continued)

FOREIGN PATENT DOCUMENTS

JP 2011196682 A * 10/2011 ..... A61L 9/04
WO WO-2006058370 A1 * 6/2006 ..... A61L 9/16

*Primary Examiner* — Stephen M Gravini
(74) *Attorney, Agent, or Firm* — Soroker Agmon Nordman PTE LTD

(57) ABSTRACT

The present application provides a towel dryer comprising a main machine, the main machine comprises a shell, a heater mounted in the shell and a fan mounted in the shell, an air outlet is arranged at a bottom of the shell corresponding to an outlet of the fan, and an air inlet is arranged at the bottom of the shell, and the heater is arranged on an airflow path of the fan, wherein the main machine further comprises a wind guide window mounted in the air outlet, and the wind guide window comprises a number of vertical air guide vanes configured to guide airflow to flow vertically downward and a number of inclined air guide vanes configured to guide the airflow to flow obliquely downward in a direction far away from the vertical air guide vanes.

10 Claims, 11 Drawing Sheets

(56) References Cited

U.S. PATENT DOCUMENTS

2018/0251932 A1* 9/2018 Jeon ..... A47B 67/005
2021/0345839 A1* 11/2021 Kim ..... F26B 21/10

* cited by examiner

TOWEL DRYER

CROSS-REFERENCE TO RELATED APPLICATIONS

This application claims priority to Chinese Patent Application No. 202022150353.3 filed on Sep. 25, 2020, the content of which is incorporated herein by reference thereto.

TECHNICAL FIELD

The present application relates to the field of dryers, and more specifically relates to a towel dryer.

BACKGROUND

Towel dryers are devices generally used to dry a cloth such as a towel, clothing and the like, in order to prevent the cloth from becoming moldy and facilitate users to use. The existing towel dryers are usually equipped with a heater and a fan in a main machine, and hot air generated by the heater is blown out by the fan to heat and dry the cloth on a rack. Due to a small air outlet of the fan, a coverage area of the hot air blown out by the main machine is limited. In order to increase the coverage area of the hot air, it is often necessary to increase the number of the fans and the heaters, and the volume of the main machine is required to be made large, its cost is high and its structure is complex.

SUMMARY

A purpose of embodiments of the present application is aimed to provide a towel dryer, so as to solve the problem of small coverage area of hot air of towel dryers in related technologies.

In order to realize the above purpose, a technical solution adopted by an embodiment of the present application is to provide a towel dryer comprising a main machine, wherein the main machine comprises a shell, a heater mounted in the shell and a fan mounted in the shell, an air outlet is arranged at a bottom of the shell corresponding to an outlet of the fan, and an air inlet is arranged at the bottom of the shell, and the heater is arranged on an airflow path of the fan, wherein the main machine further comprises a wind guide window mounted in the air outlet, and the wind guide window comprises a number of vertical air guide vanes configured to guide airflow to flow vertically downward and a number of inclined air guide vanes configured to guide the airflow to flow obliquely downward in a direction far away from the vertical air guide vanes.

In an optional embodiment, a longitudinal direction of the vertical air guide vane is parallel to a longitudinal direction of the inclined air guide vane.

In an optional embodiment, the inclined air guide vane is in a structure of a flat plate, and the inclined air guide vane extends obliquely from top to bottom in the direction far away from the vertical air guide vane.

In an optional embodiment, the inclined air guide vane comprises a bending section, and the bending section bends and extends from top to bottom in the direction far away from the vertical air guide vane.

In an optional embodiment, the inclined air guide vane further comprises a vertical section, and the bending section is connected with a lower end of the vertical section.

In an optional embodiment, both sides of an upper end of each of the vertical air guide vane and the inclined air guide vane are arranged as rounded corners.

In an optional embodiment, the wind guide window further comprises a support frame, and the vertical air guide vane and the inclined air guide vane are fixedly connected with the support frame.

In an optional embodiment, the fan comprises a fan housing mounted in the shell, a tubular wind wheel mounted in the fan housing and a motor configured to drive the tubular wind wheel to rotate, an outlet of the fan housing is located at a position near a front side of the shell, and the vertical air guide vanes are located at one side of the inclined air guide vanes near the front side of the shell.

In an optional embodiment, the main machine further comprises an ultraviolet LED module mounted at the bottom of the shell.

In an optional embodiment, the main machine further comprises a lamp holder mounted in the shell and an ultraviolet lamp tube mounted on the lamp holder, and a window configured to expose the ultraviolet lamp tube is arranged at the bottom of the shell.

The beneficial effects of the towel dryer provided by the embodiments of the present application lie in that: compared with the prior art, the towel dryer in the present application is provided with the air outlet at the bottom of the shell, and provided with the vertical air guide vanes and the inclined air guide vanes in the air outlet, the vertical air guide vanes guide the airflow to flow downward, and the inclined air guide vanes guide the airflow to flow obliquely downward in the direction facing away from the vertical air guide vanes, so that the airflow is diffused to cover a larger area, this structure is simple and its cost is low.

DESCRIPTION OF THE DRAWINGS

In order to more clearly illustrate the technical solutions in the embodiments of the present application, the drawings needed to be used in the description for the embodiments or exemplary technologies are briefly introduced below. Obviously, the drawings in the following description are only some embodiments of the present application, and other drawings may also be obtained based on these drawings for those skilled in the art without paying creative labor.

Figure 1:
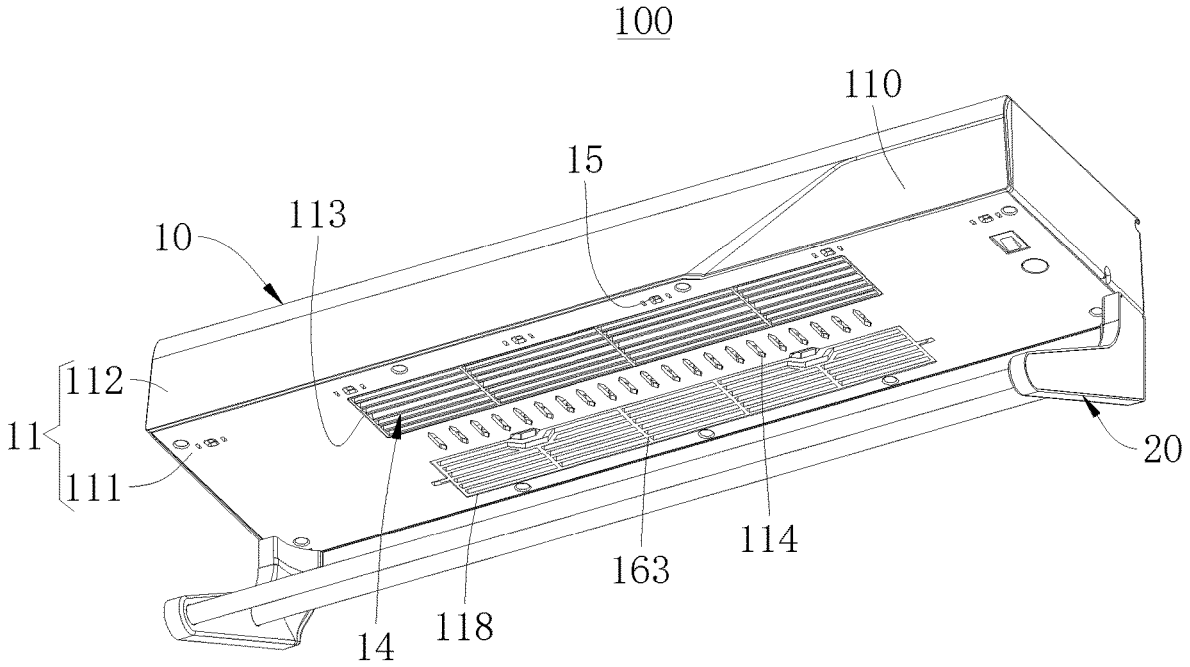
FIG. 1 is a first structural diagram of the towel dryer provided by a first embodiment of the present application.

Among them, main reference signs in the drawings are as follows:

100—towel dryer;

10—main machine; 11—shell; 110—control panel; 111—bottom plate; 112—cover; 113—air outlet; 114—air inlet; 115—through hole; 1151—heat dissipation hole; 116—hook; 1161—protruded block; 117—venthole; 118—window; 12—heater; 121—heating plate; 122—cooling fin; 13—fan; 131—fan housing; 132—tubular wind wheel; 133—motor; 14—wind guide window; 141—vertical air guide vane; 142—inclined air guide vane; 1421—bending section; 1422—vertical section; 143—support frame; 144—rib plate; 15—ultraviolet LED module; 151—ultraviolet LED lamp bead; 152—base plate; 161—lamp holder; 162—ultraviolet lamp tube; 163—grille window; 17—reflector; 171—support plate; 172—reflective side plate; 173—airflow hole;

20—rack.

Corresponding reference numerals indicate corresponding parts throughout the several views of the drawings.

DETAILED EMBODIMENTS

In order to make the technical problems to be solved, technical solutions and beneficial effects of the present application more clearly and comprehensibly, the present application is further described in detail in combination with the drawings and embodiments. It should be understood that the specific embodiments described herein are only for the purpose of illustrating the present application and are not intended to limit the present application.

In the description of the present application, the term "a plurality of" means two or more, unless it is specifically defined otherwise. The term "a number of" means one or more, unless it is specifically defined otherwise.

In the description of the present application, it should be understood that, the orientation or position relationship indicated by the term "length", "width", "thickness", "up", "down", "front", "back", "vertical", "horizontal", "top", or "bottom" etc. is based on the orientation or position relationship as shown in the attached drawings, which is only for the convenience of describing the present application and simplifying the description, rather than indicating or implying that the specified device or element must have a specific orientation, be constructed and operated in a specific orientation, and therefore it cannot be understood as a limitation of the present application.

The reference to "one embodiment", "some embodiments" or "an embodiment" described in the specification of the present application means that a specific feature, structure, or characteristic described in connection with this embodiment is included in one or more embodiments of the present application. Therefore, the statements "in an embodiment", "in some embodiments", "in some other embodiments", "in other embodiments" and so on appearing in different places of the specification do not necessarily refer to the same embodiment, but mean "one or more, but not all embodiments", unless otherwise specially emphasized. Further, in one or more embodiments, the specific features, structures or characteristics may be combined in any suitable manner.

The Chinese term and English term corresponding to the English abbreviation which is used in the present application is as follows:

LED, English: light emitting diode; Chinese: light emitting diode.

Figure 2:
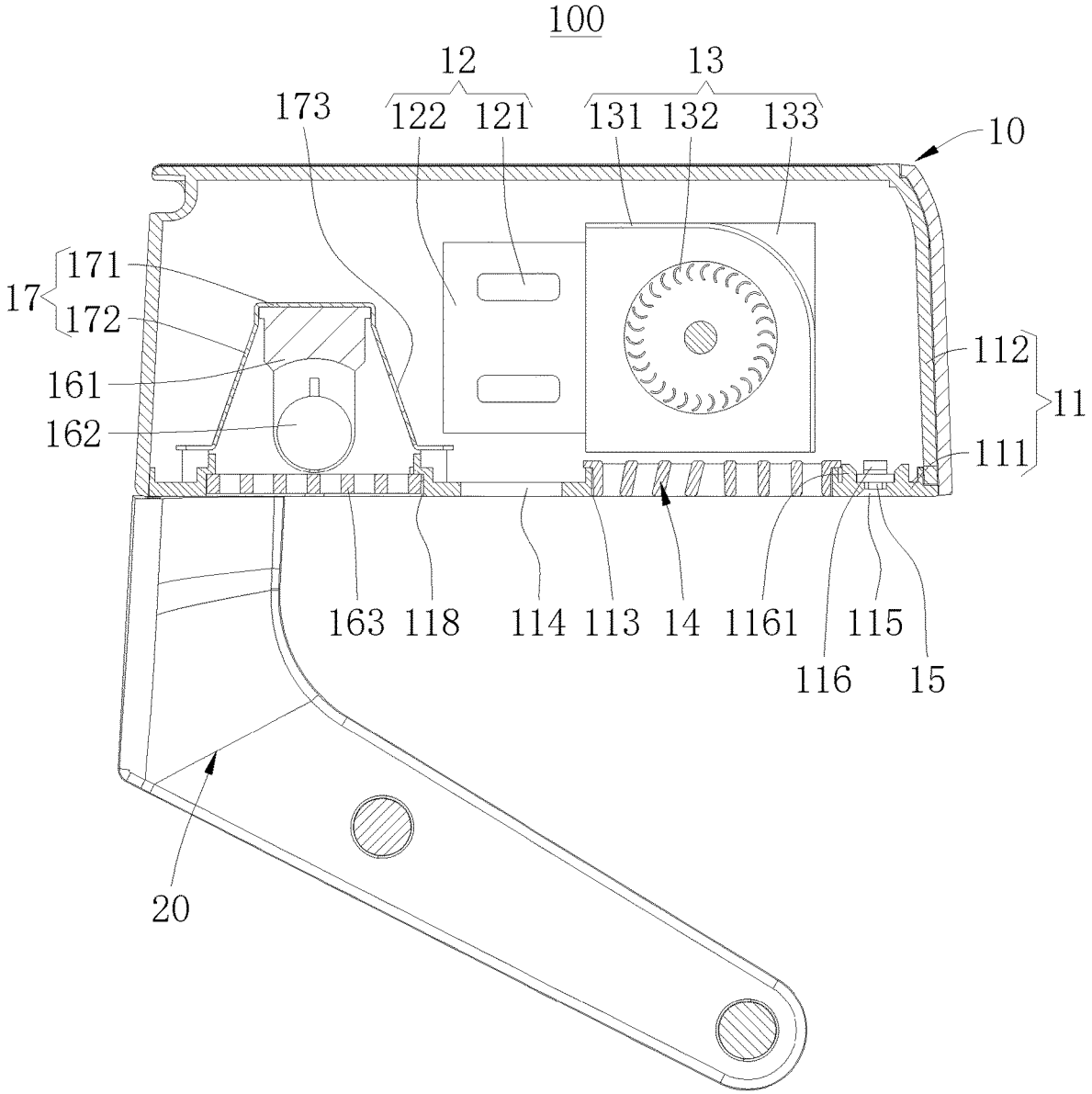
FIG. 2 is a sectional structure diagram of the towel dryer provided by the first embodiment of the present application.
Figure 3:
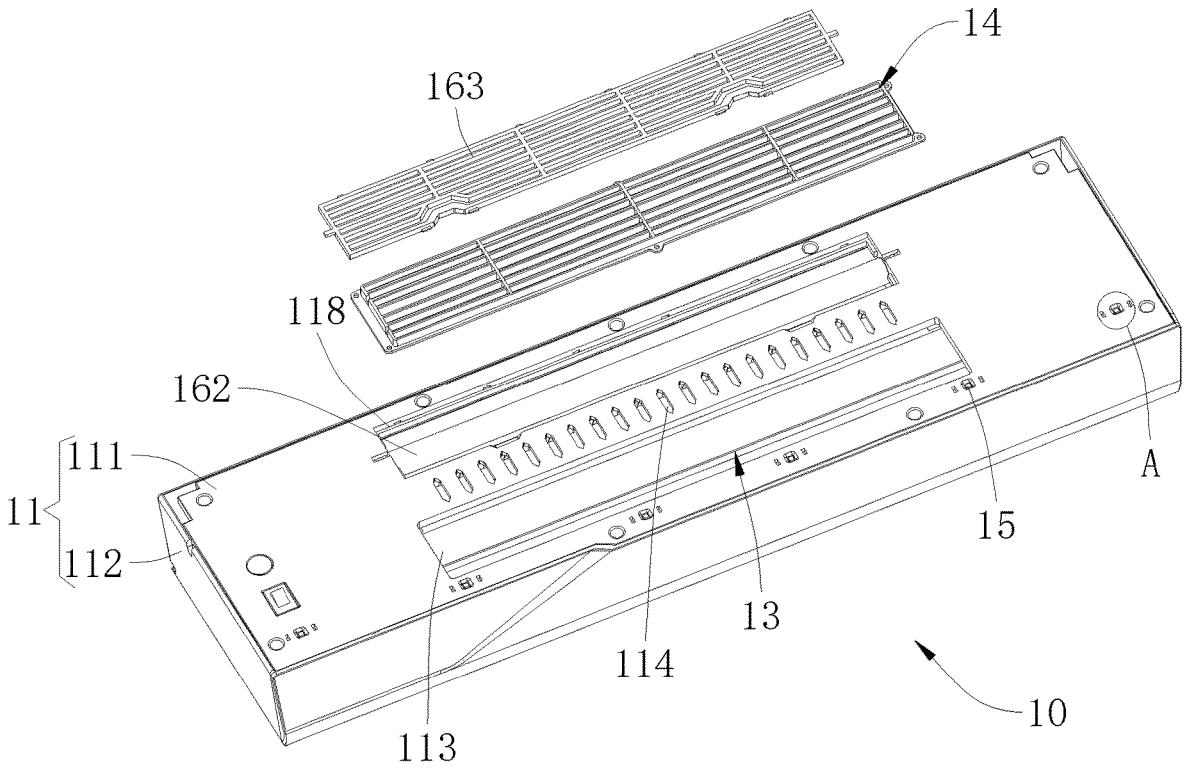
FIG. 3 is a structural diagram that a grille window and a wind guide window of the main machine as shown in FIG. 2 are separated.

Please refer to FIGS. 1 to 3, the towel dryer 100 provided in the present application is described now. The towel dryer 100 includes a main machine 10 and a rack 20, and the rack 20 is configured to hang a cloth, that is, the cloth such as a towel and the like may be hung on the rack 20, while the main machine 10 is arranged above the rack 20, so as to heat, dry and disinfect the cloth on the rack 20 through the main machine 10. The rack 20 may be supported at a bottom of the shell to integrate the rack 20 and the main machine 10 into one piece, so as to facilitate the mounting and use. Of course, in some embodiments, the rack 20 may also be arranged separately to mount the rack 20 and the main machine 10 on the wall respectively. In some other embodiments, the towel dryer 100 may also only include the main machine 10, which is mounted above the existing rack 20 in a room.

Figure 5:
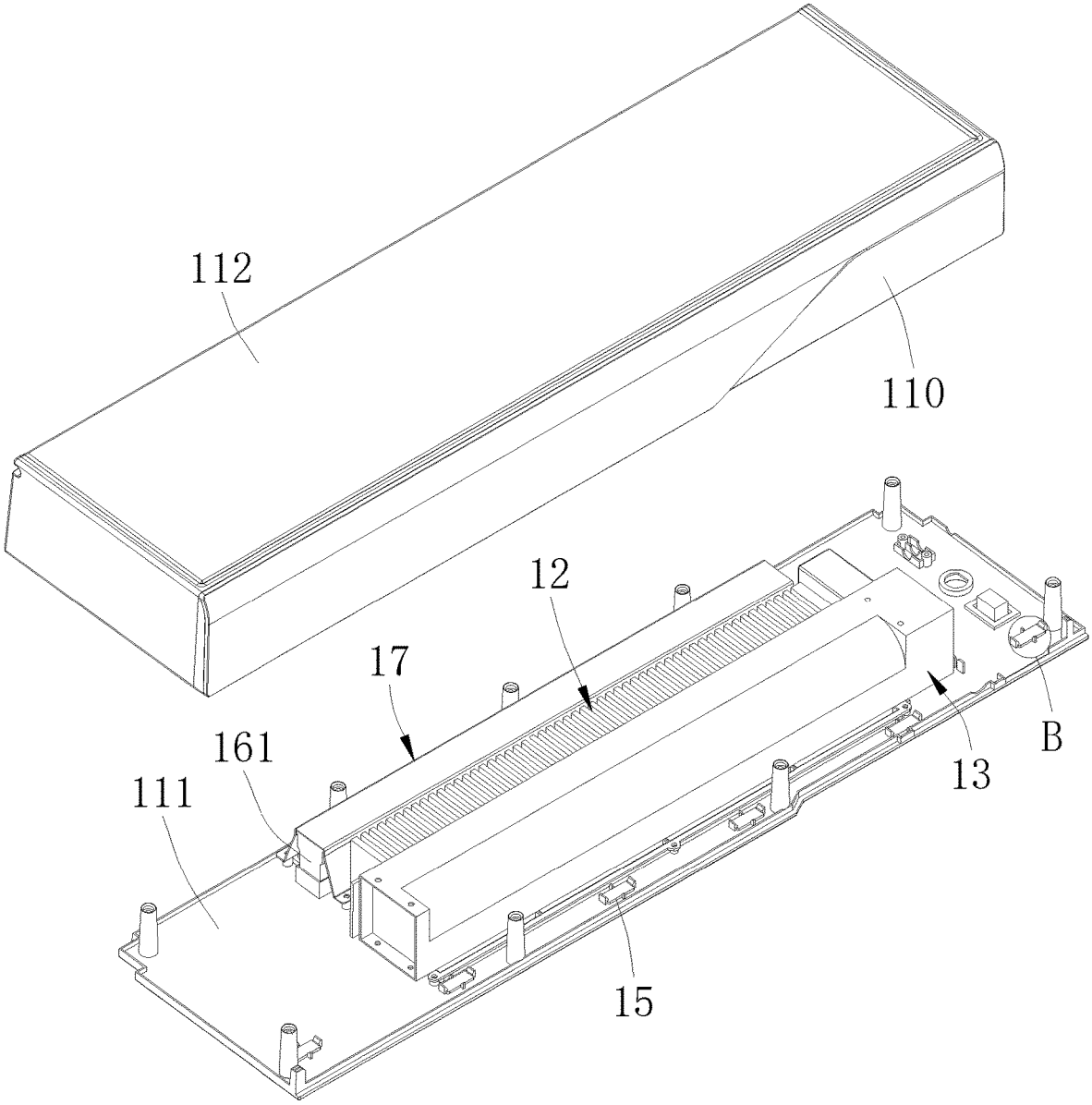
FIG. 5 is an exploded structure diagram of the main machine as shown in FIG. 3.

Please refer to FIG. 2, FIG. 3 and FIG. 5, the main machine 10 includes a shell 11, a heater 12 and a fan 13, and the heater 12 and the fan 13 are mounted in the shell 11 and protected by the shell 11. The heater 12 is arranged on an airflow path of the fan 13 and configured to heat the air, and the fan 13 blows out the heated air to dry the cloth. An air outlet 113 and an air inlet 114 are arranged at the bottom of the shell 11, and the air outlet 113 is located at an outlet of the fan 13 to blow out the airflow.

Figure 8:
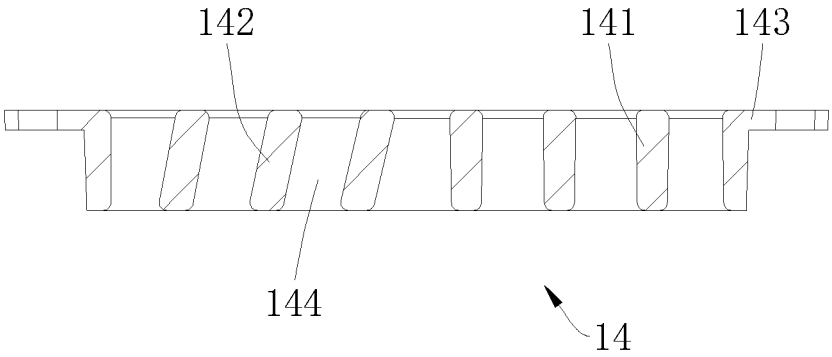
FIG. 8 is a sectional structure diagram of the wind guide window as shown in FIG. 7.

Please refer to FIG. 2, FIG. 3 and FIG. 8, the main machine 10 further includes a wind guide window 14 mounted in the air outlet 113 and configured to guide the airflow diffusion, that is, the airflow blown out by the fan 13 is guided by the wind guide window 14 for diffusion when passing through the wind guide window 14, so as to better heat and dry the cloth. The wind guide window 14 includes a number of vertical air guide vane 141 and a number of inclined air guide vane 142; the vertical air guide vane 141 is configured to guide the airflow to flow vertically downward; the inclined air guide vane 142 is configured to guide the airflow to flow obliquely downward, and the inclined air guide vane 142 guides the airflow to flow in a direction facing away from the vertical air guide vane 141, that is, the inclined air guide vane 142 is configured to guide the airflow to flow obliquely downward in the direction facing away from the vertical air guide vane 141, such that the airflow can cover a larger area, and then the hot air from the air outlet 113 is guided to cover a larger area, so as to better dry the underneath cloth.

Compared with the prior art, the towel dryer 100 provided in the present application is provided with the air outlet 113 at the bottom of the shell 11, and provided with the vertical air guide vane 141 and the inclined air guide vane 142 in the air outlet 113, the vertical air guide vane 141 guides the airflow to flow downward, and the inclined air guide vane 142 guides the airflow to flow obliquely downward in the direction facing away from the vertical air guide vane 141, so that the airflow is diffused to cover a larger area. Its structure is simple and its cost is low.

In an embodiment, please refer to FIG. 1 and FIG. 2, the shell 11 includes a bottom plate 111 and a cover 112 covered on the bottom plate 111, so that the bottom plate 111 forms the bottom of the shell 11, and the air outlet 113 and the air inlet 114 are arranged on the bottom plate 111. The shell 11 is convenient for processing and manufacturing, and also convenient for the mounting and fixation of the heater 12 and the fan 13. Of course, in some other embodiments, the shell 11 may also be formed by assembling a plurality of plates.

In an embodiment, please refer to FIG. 1 and FIG. 2, a control panel 110 is arranged at a front side of the shell 11, and the control panel 110 is arranged as inclined to a rear side of the shell 11 from top to bottom, so as to facilitate the user to operate and determine the position of the control panel 110. In an embodiment, the control panel 110 is arranged on the cover 112 to facilitate processing.

Figure 4:
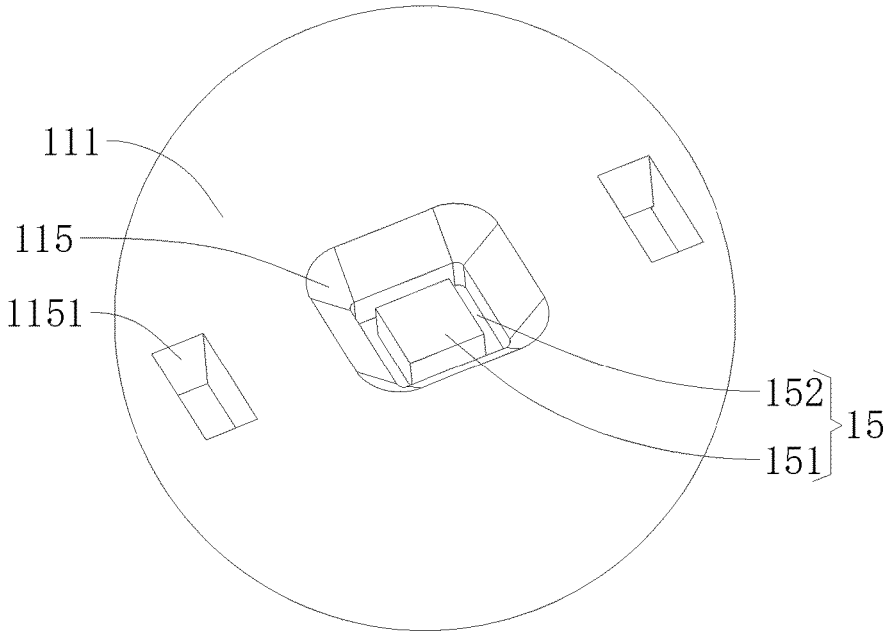
FIG. 4 is an enlarged view of a part A in FIG. 3.

In an embodiment, please refer to FIGS. 2 to 4, the main machine 10 further includes a ultraviolet LED module 15 mounted at the bottom of the shell 11, so as to support the ultraviolet LED module 15 through the shell 11. The ultraviolet LED module 15 includes a base plate 152 and a ultraviolet LED lamp bead 151. The base plate 152 is mounted at the bottom of the shell 11, and the ultraviolet LED lamp bead 151 is mounted on the base plate 152, so as to support and control the ultraviolet LED lamp bead 151 through the base plate 152, such that the ultraviolet LED lamp bead 151 emits ultraviolet light to disinfect the cloth. Because the size of the ultraviolet LED module 15 is relatively small, the corresponding space of the shell 11 occupied by the ultraviolet LED module 15 is small, thus the shell 11 may be made smaller, which is able to facilitate the location layout of the ultraviolet LED module 15, and further facilitate the control of the area covered by the ultraviolet light emitted from the ultraviolet LED module 15. Moreover, the use of the ultraviolet LED module 15 can save more energy and is convenient to mount and fix, thus the structure of the main machine 10 is simplified, and is convenient for assembly and processing of the main machine 10.

In an embodiment, please refer to FIGS. 1 to 3, the main machine 10 further includes a lamp holder 161 and a ultraviolet lamp tube 162, and the lamp holder 161 is mounted in the shell 11 and protected by the shell 11. The ultraviolet lamp tube 162 is mounted on the lamp holder 161, and the lamp holder 161 supports the ultraviolet lamp tube 162 and supplies power to the ultraviolet lamp tube 162, such that the ultraviolet lamp tube 162 can emit ultraviolet light and then disinfect the cloth. The bottom of the shell 11 is provided with a window 118, and the window 118 is located at a position corresponding to the reflector so as to expose the ultraviolet lamp tube 162, so that the ultraviolet light emitted by the ultraviolet lamp tube 162 can be emitted.

In an embodiment, please refer to FIGS. 1 to 3, the main machine 10 further includes a reflector 17 mounted in the shell 11, and the reflector 17 is protected through the shell 11. The reflector 17 covers the lamp holder 161, and then the reflector 17 may cover the ultraviolet lamp tube 162 when the ultraviolet lamp tube 162 is mounted on the lamp holder 161, so as to reflect the ultraviolet light emitted by the ultraviolet lamp tube 162 to a specified direction, thereby improving the utilization rate of the ultraviolet light and saving more energy, and avoiding corresponding parts being aged due to that the ultraviolet light emitted by the ultraviolet lamp tube 162 illuminates other parts in the shell 11.

In an embodiment, please refer to FIGS. 1 to 3, the reflector 17 is located on the air inlet path of the fan 13, and an airflow hole 173 is arranged on the reflector 17, so that the air will enter the reflector 17 through the window 118 and then enter the fan 13 from the airflow hole 173, so as to perform heat dissipation for the lamp holder 161 and ultraviolet lamp tube 162 in the reflector 17, thereby improving the service life of the ultraviolet lamp tube 162 and lamp holder 161. Moreover, after entering the reflector 17, the air will be heated by the ultraviolet lamp tube 162, so that the heat generated by the ultraviolet lamp tube 162 can be used to further improve the energy utilization rate and reduce the power consumption. The arrangement of the reflector 17 may improve the utilization rate of the light emitted by the ultraviolet lamp tube 162, and the reflector 17 is arranged on the air inlet path of the fan 13 and the airflow hole 173 is arranged on the reflector 17, such that the airflow will enter the fan 13 through the reflector 17 and then be blown out, in this way the ultraviolet lamp tube 162 may be heat-dissipated and cooled, and the service life of the ultraviolet lamp tube 162 can be improved. Further, the heat generated by the ultraviolet lamp tube 162 may be used to heat the airflow at the inlet of the fan 13 to improve the energy utilization and reduce the energy consumption.

In an embodiment, the window 118 is located at a position corresponding to the rear bottom of the shell 11, so that the window 118 is closer to the wall when in use. In this way, the ultraviolet lamp tube 162 is also closer to the wall, so as to better limit the range of ultraviolet light and improve the safety.

In an embodiment, please refer to FIGS. 1 to 3, the bottom of the shell 11 is provided with the ultraviolet lamp tube 162 and the ultraviolet LED module 15. On the basis that the ultraviolet lamp tube 162 disinfects the coverage area, the coverage area to be disinfected may be increased through the ultraviolet LED module 15. Since the size of the ultraviolet LED module 15 is relatively small, the corresponding space of the shell 11 occupied by the ultraviolet LED module 15 is small, so the shell 11 may be made smaller. Moreover, the ultraviolet lamp tube 162 and ultraviolet LED module 15 cooperate to achieve a large coverage area to be disinfected.

In an embodiment, there are a plurality of ultraviolet LED modules 15, so as to increase the coverage area of the ultraviolet light and facilitate the mounting and layout of each of the ultraviolet LED modules 15. In some other embodiments, there may also be one ultraviolet LED module 15.

In an embodiment, please refer to FIG. 2 and FIG. 4, the ultraviolet lamp tube 162 is located at the corresponding position close to the rear side of the shell 11, and the ultraviolet LED module 15 is located at the corresponding position close to the front side of the shell 11. Therefore, after the shell 11 is mounted on the wall, the ultraviolet lamp tube 162 can be better protected. In addition, the space occupied by the ultraviolet lamp tube 162 in the shell 11 can be reduced, and the ultraviolet LED module 15 is located at a position corresponding to the front side of the shell 11 to facilitate the layout and increase the coverage area disinfected by the ultraviolet light.

In an embodiment, please refer to FIGS. 1 to 3, the ultraviolet lamp tube 162 and the ultraviolet LED module 15 are respectively located on two sides of the fan 13 and the heater 12, that is, the fan 13 and the heater 12 are located between the ultraviolet lamp tube 162 and the ultraviolet LED module 15. In this embodiment, the side of the heater 12 facing away from the fan 13 is provided with the ultraviolet lamp tube 162, and the side of the fan 13 facing away from the heater 12 is provided with the ultraviolet LED module 15. In some other embodiments, the side of the heater 12 facing away from the fan 13 is provided with the ultraviolet LED module 15, and the side of the fan 13 facing away from the heater 12 is provided with the ultraviolet lamp tube 162. In this way, the ultraviolet lamp tube 162 and the fan 13 will occupy a large volume of the shell 11, which will make a part of the main machine 10 located at the side of the fan 13 facing away from the ultraviolet lamp tube 162 difficult to be covered by ultraviolet light, but the arrangement of the ultraviolet LED module 15 at the side of the fan 13 facing away from the ultraviolet lamp tube 162 can improve the coverage area of the ultraviolet light and improve the disinfection effect of the main machine 10.

In an embodiment, please refer to FIGS. 1 to 3, the heater 12 may be arranged at the inlet of the fan 13, and then the air is inhaled and accelerated by the fan 13 after heated by the heater 12 and then blown out. Due to the relatively small airflow velocity at the inlet of the fan 13, the air may be fully heated by the heater 12 firstly and then enter the fan 13, so the heat utilization rate is high, and the power of corresponding heater 12 can be made lower. In some other embodiments, the heater 12 may also be arranged at the outlet of the fan 13, so the airflow blown out by the fan 13 is heated by the heater 12 and then flows out.

In an embodiment, please refer to FIGS. 1 to 3, the airflow hole 173 is arranged on the side of the reflector 17 close to the fan 13, so that the air is easier to enter the fan 13 from the airflow hole 173 after entering the reflector 17, so as to reduce the air resistance. Of course, in some other embodiments, the airflow holes 173 may also be provided on both sides of the reflector 17. In still some embodiments, the airflow hole 173 may be provided on the side of the reflector 17 facing away from the fan 13.

In an embodiment, the ultraviolet lamp tube 162 may be detachably mounted on the lamp holder 161 to facilitate the replacement of the ultraviolet lamp tube 162.

In an embodiment, please refer to FIGS. 1 to 3, the reflector 17 includes two reflective side plates 172 and a support plate 171, and the airflow hole 173 is arranged on the reflective side plate 172. The support plate 171 is connected with upper sides of the two reflective side plates 172, that is, the support plate 171 is connected with one side of each of the two reflective side plates 172 facing away from the window 118. When in use, the two reflective side plates 172 are located on two sides of the lamp holder 161, such that the two reflective side plates 172 are located on two sides of the ultraviolet lamp tube 162 when the ultraviolet lamp tube 162 is mounted on the lamp holder 161 to reflect light. The distance between the two reflective side plates 172 is gradually enlarged from the support plate 171 to a direction far away from the support plate 171, in this way, not only the light emitted by the ultraviolet lamp tube 162 can be reflected, but also it is ensured that the reflected light covers a relatively large area.

In an embodiment, the reflector 17 may be formed by stamping a metal plate to facilitate processing and manufacturing. In addition, the reflector 17 may also be used to perform heat dissipation for the ultraviolet lamp tube 162. Of course, in some embodiments, the reflector 17 may also be a plastic cover, and a reflective coating is arranged on an inner surface of the plastic cover.

In an embodiment, the lower end of the reflective side plate 172 may be fixed at the bottom of the shell 11, that is, the end of the reflective side plate 172 far away from the support plate 171 is fixed at the bottom of the shell 11 to mount the reflector 17 in the shell 11.

In an embodiment, the support plate 171 of the reflector 17 may be fixedly connected with the lamp holder 161, while the lamp holder 161 is fixed in the shell 11, such that the reflector 17 is supported through the lamp holder 161.

In still some embodiments, the lower end of the reflective side plate 172 may be fixed at the bottom of the shell 11, while the support plate 171 of the reflector 17 is fixedly connected with the lamp holder 161, so as to ensure the mounting stability of the reflector 17.

In an embodiment, please refer to FIGS. 1 to 3, the fan 13 includes a fan housing 131, a tubular wind wheel 132 and a motor 133. The motor 133 is connected with the tubular wind wheel 132 such that the tubular wind wheel 132 is driven by the motor 133 to rotate, and the tubular wind wheel 132 is mounted in the fan housing 131 so as to guide the airflow through the fan housing 131. By using the tubular wind wheel 132, the volume may be made smaller and the air volume is large, so the volume of the main machine 10 may be made smaller. Of course, in some other embodiments, other structure of the fan 13 may also be adopted.

In an embodiment, the heater 12 is arranged between the fan 13 and the reflector 17, and the heater 12 is located at the inlet of the fan 13. In this way, the air enters the heater 12 for heating after preheated by the reflector 17, and then enters the fan 13. This structure can better heat the air, improve the energy utilization rate, and make the power of the heater 12 smaller.

In an embodiment, the air inlet 114 is located at the position corresponding to the heater 12, such that a part of the air will go to the fan 13 via the reflector 17, and the other part of the air will enter the heater 12 directly from the bottom of the shell 11 for heating, so as to reduce the air resistance and ensure that the fan 13 is provided with sufficient air output.

In an embodiment, please refer to FIGS. 1 to 3, the main machine 10 further includes a grille window 163 detachably mounted at the bottom of the shell 11 and covering the window 118, so as to protect the ultraviolet lamp tube 162 in the reflector 17, and transmit light and ventilate through the grille window 163.

In an embodiment, the grille window 163 may adopt a light-transmitting material so that the light emitted by the ultraviolet lamp tube 162 may be emitted through the grille window 163 to improve the utilization rate of the light.

In an embodiment, please refer to FIGS. 1 to 3, the heater 12 includes a heating plate 121 and a plurality of cooling fins 122, and the plurality of cooling fins 122 are arranged on the heating plate 121 to heat the air more efficiently and quickly. The use of the heating plate 121 has high safety. Of course, in some other embodiments, the heater 12 may also adopt a heating wire, a heating tube, etc.

In an embodiment, please refer to FIGS. 2 to 4, the ultraviolet LED module 15 is mounted inside the shell 11, so as to protect the ultraviolet LED module 15 through the shell 11. The bottom of the shell 11 is provided with a through hole 115 located at a position corresponding to the ultraviolet LED module 15, so as to expose the corresponding ultraviolet LED lamp bead 151, so that the ultraviolet light emitted by the corresponding ultraviolet LED lamp bead 151 may be emitted out. In some other embodiments, the ultraviolet LED module 15 may also be mounted outside the shell 11, so the ultraviolet LED module 15 is easy to mount and it is convenient for the user to select.

In an embodiment, please refer to FIGS. 2 to 4, the cross-sectional area of the through hole 115 on the shell 11 is gradually enlarged from the inside of the shell 11 to the outside of the shell 11, so that the through hole 115 defines a light-emitting angle of the ultraviolet LED lamp bead 151, and the ultraviolet light emitted by the ultraviolet LED lamp bead 151 covers a relatively large area. In some embodiments, a lens may also be covered on the ultraviolet LED lamp bead 151 to adjust the light-emitting angle of the ultraviolet LED lamp bead 151.

In an embodiment, a light reflective layer (not shown in the figure) is provided on the inner surface of the through hole 115 of the shell 11, so as to form a reflecting cup by the through hole 115 and improve the utilization rate of the light emitted by the ultraviolet LED lamp bead 151. In some other embodiments, the reflection cup may also be provided separately to reflect the light emitted by the ultraviolet LED lamp bead 151.

Figure 6:
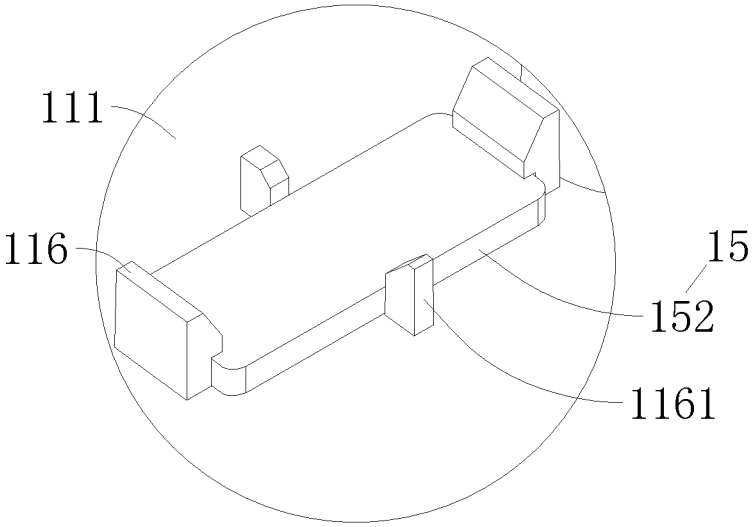
FIG. 6 is an enlarged view of a Part B as shown in FIG. 5.

In an embodiment, please refer to FIG. 2, FIG. 5 and FIG. 6, the bottom of the shell 11 is provided with a hook 116, so that the base plate 152 may be fixed by the hook 116 to facilitate the mounting and fixation of the ultraviolet LED module 15. When the ultraviolet LED module 15 is mounted inside the shell 11, the hook 116 is also arranged inside the shell 11. When the ultraviolet LED module 15 is mounted outside the shell 11, the hook 116 is also arranged outside the shell 11.

In an embodiment, the hooks 116 are arranged in pairs, and the pair of hooks 116 is respectively engaged with two ends of the corresponding base plate 152, and the bottom of the shell 11 is further provided with protruded blocks 1161 which are respectively positioned on both sides of the corresponding base plate 152. In this way, when the ultraviolet LED module 15 is mounted, the base plate 152 may be placed between the corresponding two protruded blocks 1161, and the pair of hooks 116 may clamp two ends of the base plate 152 to fix the base plate 152, which is easy to mount and fix, is provided with accurate positioning, and further facilitates the manufacture of the hooks 116 and the protruded blocks 1161. In some other embodiments, the hooks 116 may be used to engage with four sides of the base plate 152 to fix the base plate 152. In still some embodiments, screws may also be used to fix the base plate 152.

In an embodiment, please refer to FIG. 2, FIG. 5 and FIG. 6, when the ultraviolet LED module 15 is mounted inside the shell 11, a heat dissipation hole 1151 is provided at a position of the bottom of the shell 11 corresponding to each base plate 152, so that the heat dissipation of the base plate 152 may be carried out through the heat dissipation hole 1151.

In an embodiment, the heat dissipation hole 1151 is arranged at a position corresponding to each hook 116, which can facilitate the integral injection molding of the hook 116 and the shell 11, and is convenient for processing.

Figure 7:
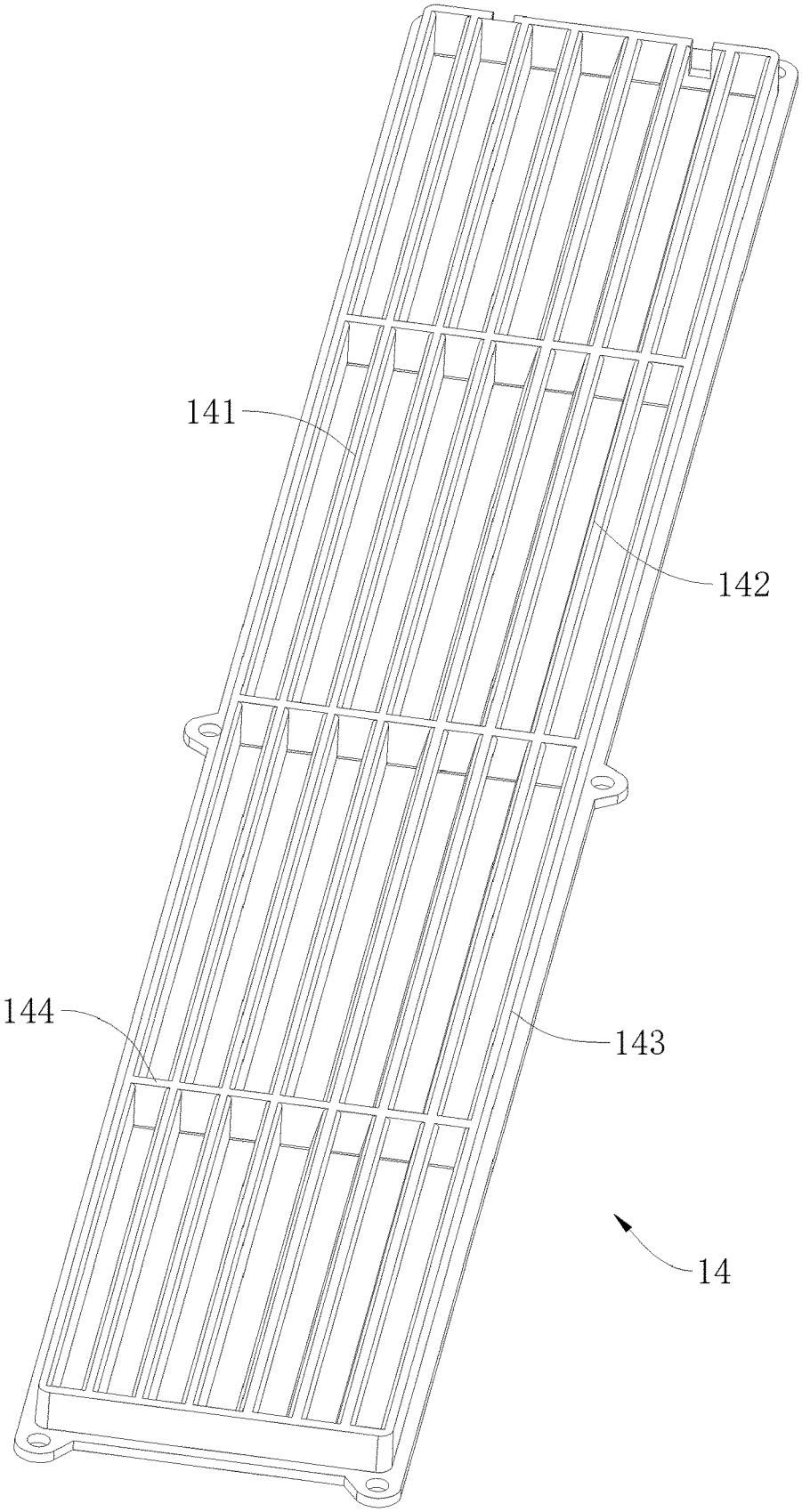
FIG. 7 is a structural diagram of the wind guide window as shown in FIG. 3.

In an embodiment, please refer to FIG. 7 and FIG. 8, the longitudinal direction of the vertical air guide vane 141 is parallel to the longitudinal direction of the inclined air guide vane 142, so as to facilitate the mounting and layout of the vertical air guide vane 141 and the inclined air guide vane 142, as well as facilitate the design and production, and thus the airflow is guided to diffuse more smoothly. Of course, in some embodiments, the longitudinal direction of the vertical air guide vane 141 may have a certain inclination angle with the longitudinal direction of the inclined air guide vane 142. In some other embodiments, other layouts may be adopted, for example, the longitudinal direction of the vertical air guide vane 141 is arranged to be perpendicular to the longitudinal direction of the inclined air guide vane 142, or the like.

In an embodiment, please refer to FIG. 7 and FIG. 8, the inclined air guide vane 142 is in a shape of flat plate, which is convenient for processing and manufacturing; the inclined air guide vane 142 extends obliquely from top to bottom in the direction far away from the vertical air guide vane 141, so as to better avoid mutual interference between the airflow guided by the inclined air guide vane 142 and the airflow guided by the vertical air guide vane 141, thereby guiding the diffusion of the airflow smoothly.

In an embodiment, both sides of the upper ends of the vertical air guide vane 141 and the inclined air guide vane 142 are arranged with rounded corners, that is, the two sides of the upper end of the vertical air guide vane 141 are respectively arranged with rounded corners, and the two sides of the upper end of the inclined air guide vane 142 are respectively arranged with rounded corners, so as to reduce the resistance to the airflow and further guide the airflow to flow more smoothly.

In an embodiment, the wind guide window 14 further includes a support frame 143, and the vertical air guide vane 141 and the inclined air guide vane 142 are fixedly connected with the support frame 143, so that the vertical air guide vane 141 and the inclined air guide vane 142 are supported by the support frame 143, so as to facilitate mounting the wind guide window 14 in the air outlet 113 of the shell 11. Of course, in some other embodiments, the vertical air guide vane 141 and the inclined air guide vane 142 may be separately mounted in the air outlet 113.

In an embodiment, the wind guide window 14 further includes a rib plate 144 mounted in the support frame 143, and the vertical air guide vane 141 and the inclined air guide vane 142 are connected with the rib plate 144 to stably support the vertical air guide vane 141 and the inclined air guide vane 142, so as to increase the strength of the wind guide window 14.

In an embodiment, the wind guide window 14 is integrally formed to facilitate processing and manufacturing, and to ensure good strength of the wind guide window 14.

Figure 9:
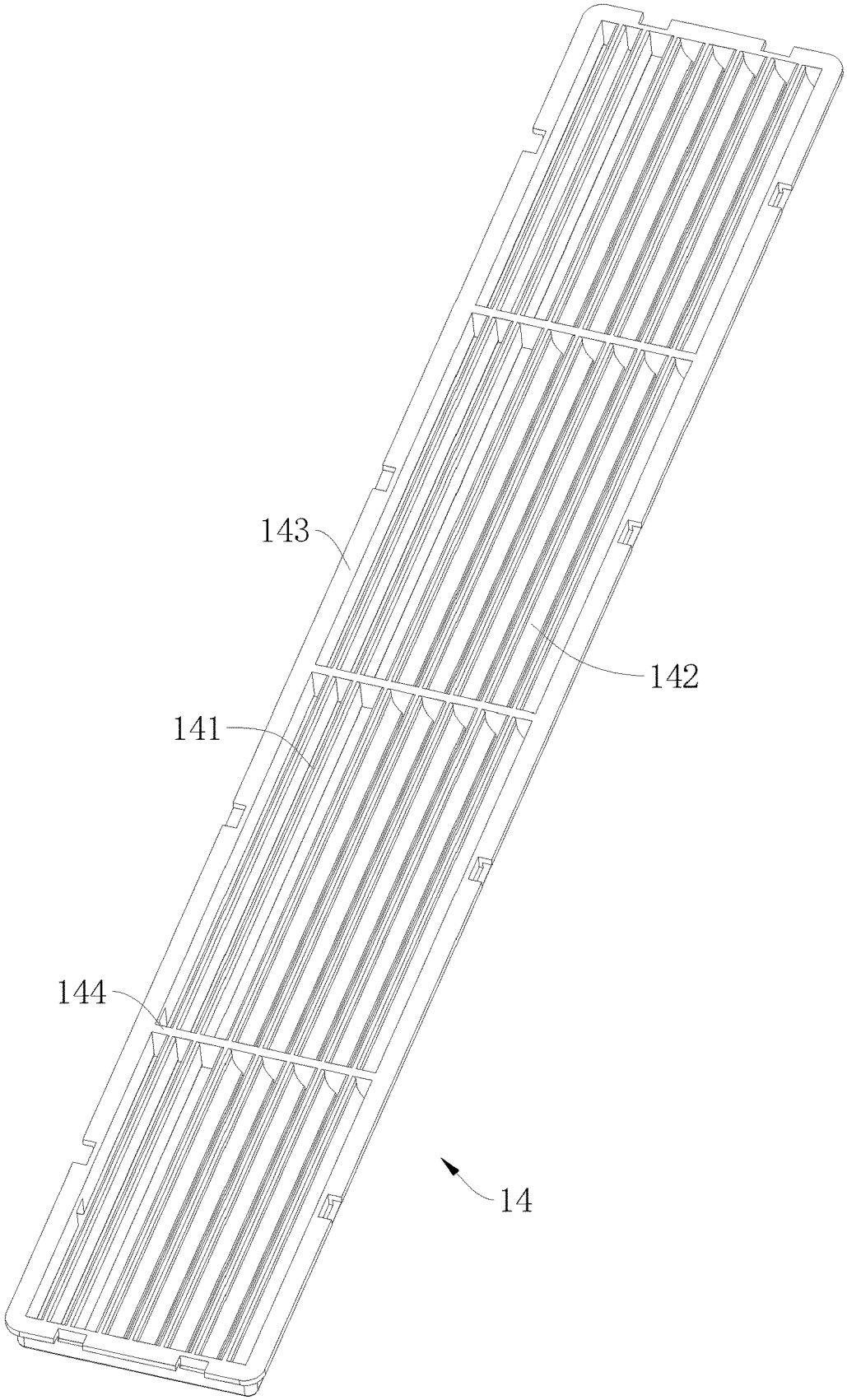
FIG. 9 is a structural diagram of the wind guide window provided by a second embodiment of the present application.
Figure 10:
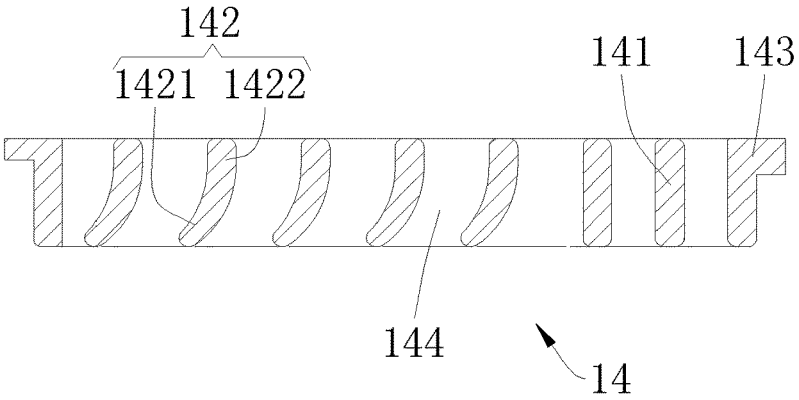
FIG. 10 is a sectional structure diagram of the wind guide window as shown in FIG. 9.

In an embodiment, please refer to FIGS. 9 and 10, the inclined air guide vane 142 includes a vertical section 1422 and a bending section 1421, and lower ends of the bending section 1421 and the vertical section 1422 are connected with each other. The bending section 1421 bends and extends from top to bottom in a direction far away from the vertical air guide vane 141, and the airflow is guided into a space between the two adjacent inclined air guide vanes 142 by the vertical section 1422 and then guided to flow obliquely by the bending section 1421, in this way the airflow may be more smoothly guided to flow obliquely downward in the direction far away from the vertical guide vane 141, so as to better guide the downward diffusion of the airflow.

Figure 11:
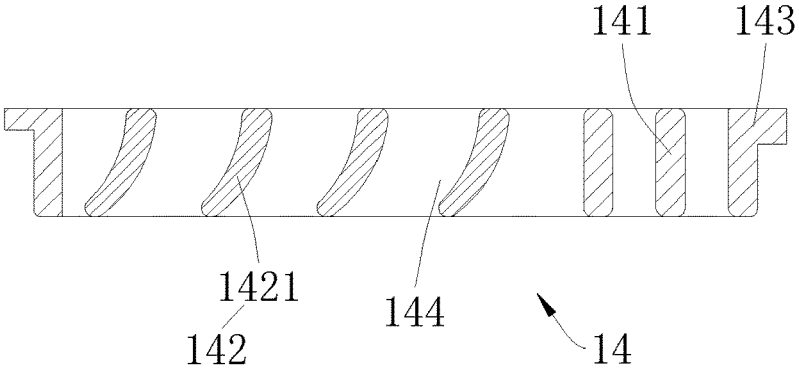
FIG. 11 is a sectional structure diagram of the wind guide window provided by a third embodiment of the present application.

In an embodiment, please refer to FIG. 11, the inclined air guide vane 142 only includes the bending section 1421, and the airflow is guided to flow obliquely downward through the bending section 1421, thus this structure is convenient for design.

Figure 12:
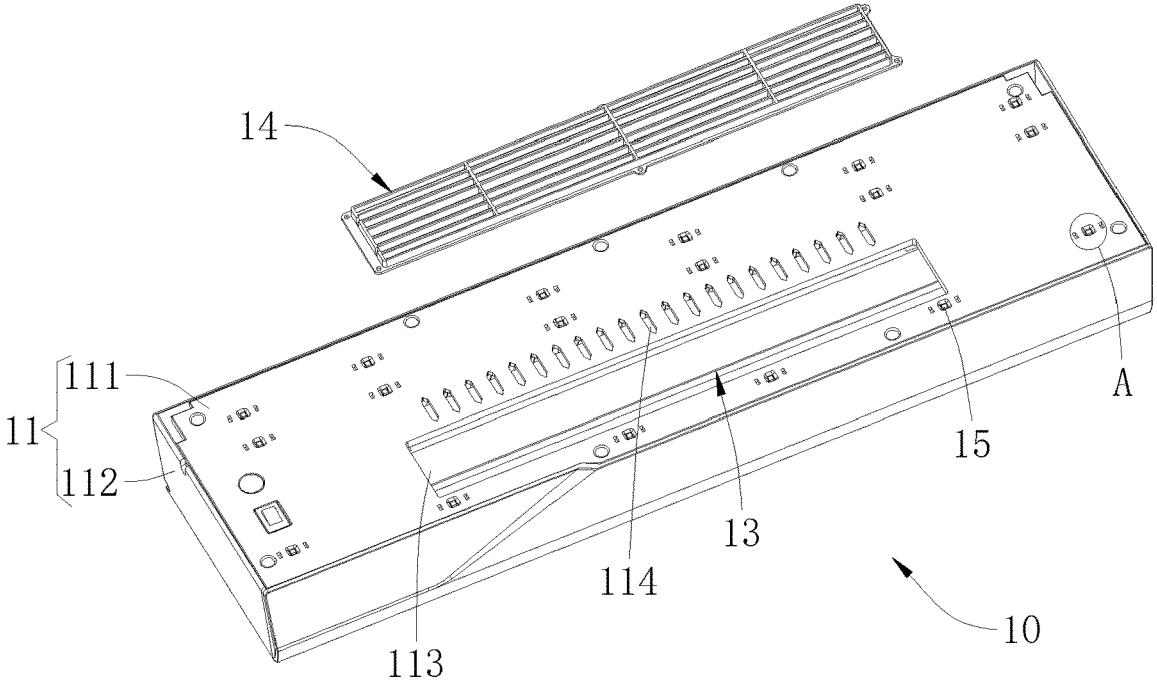
FIG. 12 is a structural diagram that the wind guide window of the main machine provided by a fourth embodiment of the present application is separated.
Figure 13:
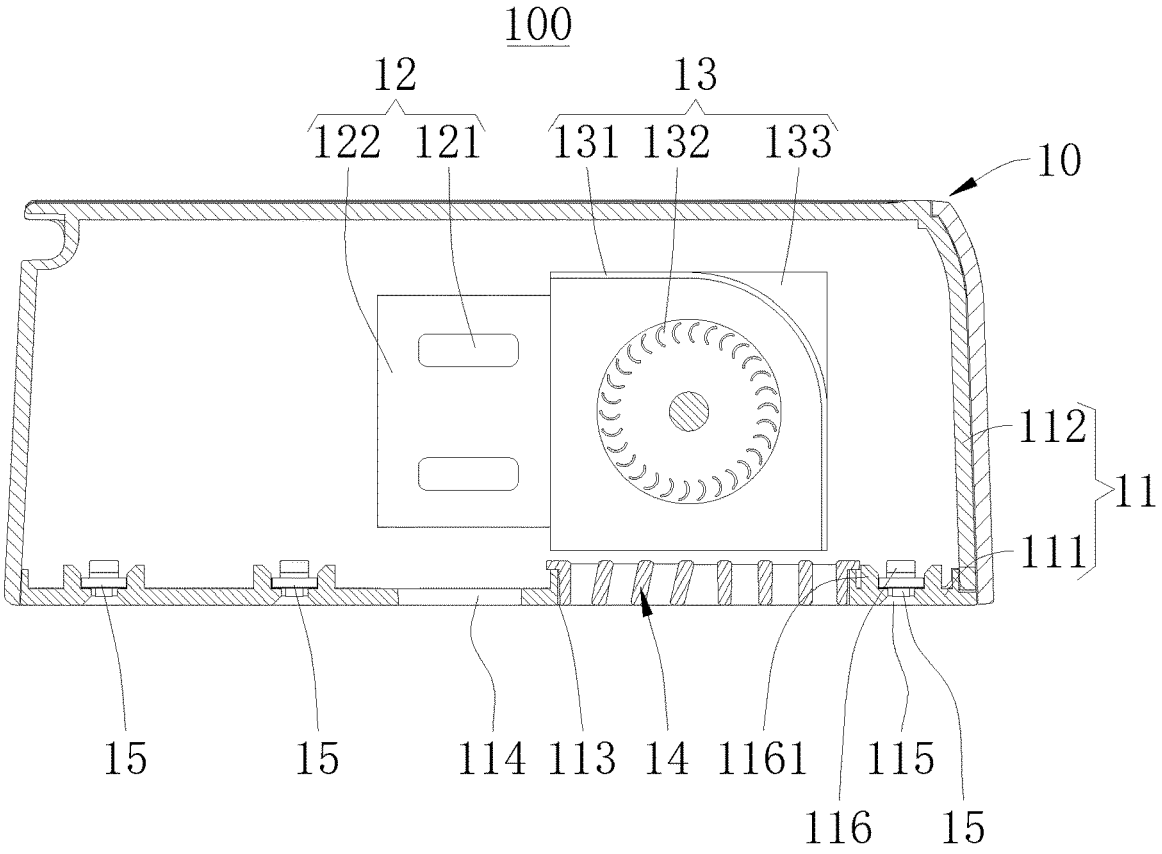
FIG. 13 is a sectional structure diagram of the main machine as shown in FIG. 12.

In an embodiment, please refer to FIG. 12 and FIG. 13, the side of the heater 12 facing away from the fan housing 131 is provided with the ultraviolet LED module 15, and the side of the fan housing 131 facing away from the heater 12 is provided with the ultraviolet LED module 15. In other words, the front side and rear side of the entirety formed by the heater 12 and the fan housing 131 are respectively provided with the ultraviolet LED modules 15, so as to reduce the coverage blind area of the ultraviolet light generated due to that the heater 12 and the fan housing 131 occupy the bottom space of the shell 11, and to further ensure that the ultraviolet light emitted by the ultraviolet LED modules 15 can better cover the area below the main machine 10.

In an embodiment, at least two rows of ultraviolet LED modules 15 are arranged at a position near to the rear side of the shell 11, and one row of ultraviolet LED modules 15 are arranged near the front side of the shell 11. Since the rear side of the shell 11 is often close to the wall when in use, it is difficult to be exposed to external light, therefore the arrangement of at least two rows of ultraviolet LED modules 15 near the rear side of the shell 11 can enhance the ultraviolet illumination intensity and better disinfect the cloth close to the wall.

Figure 14:
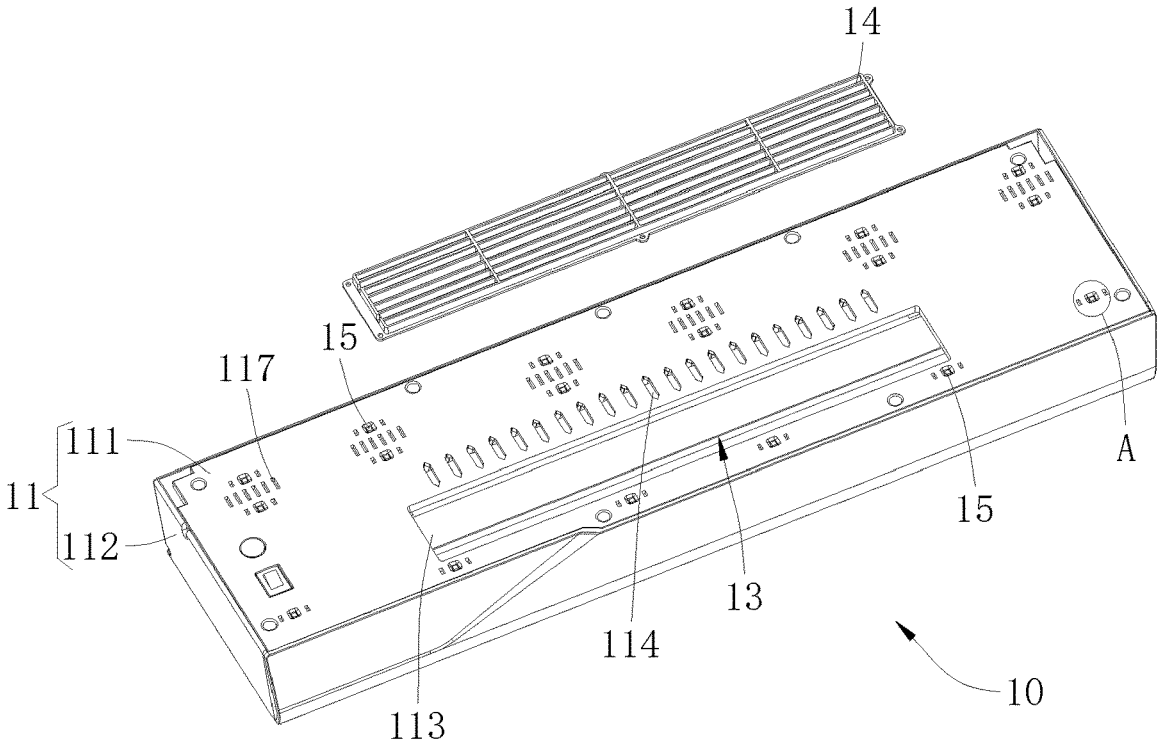
FIG. 14 is a structural diagram that the wind guide window of the main machine provided by a fifth embodiment of the present application is separated.
Figure 15:
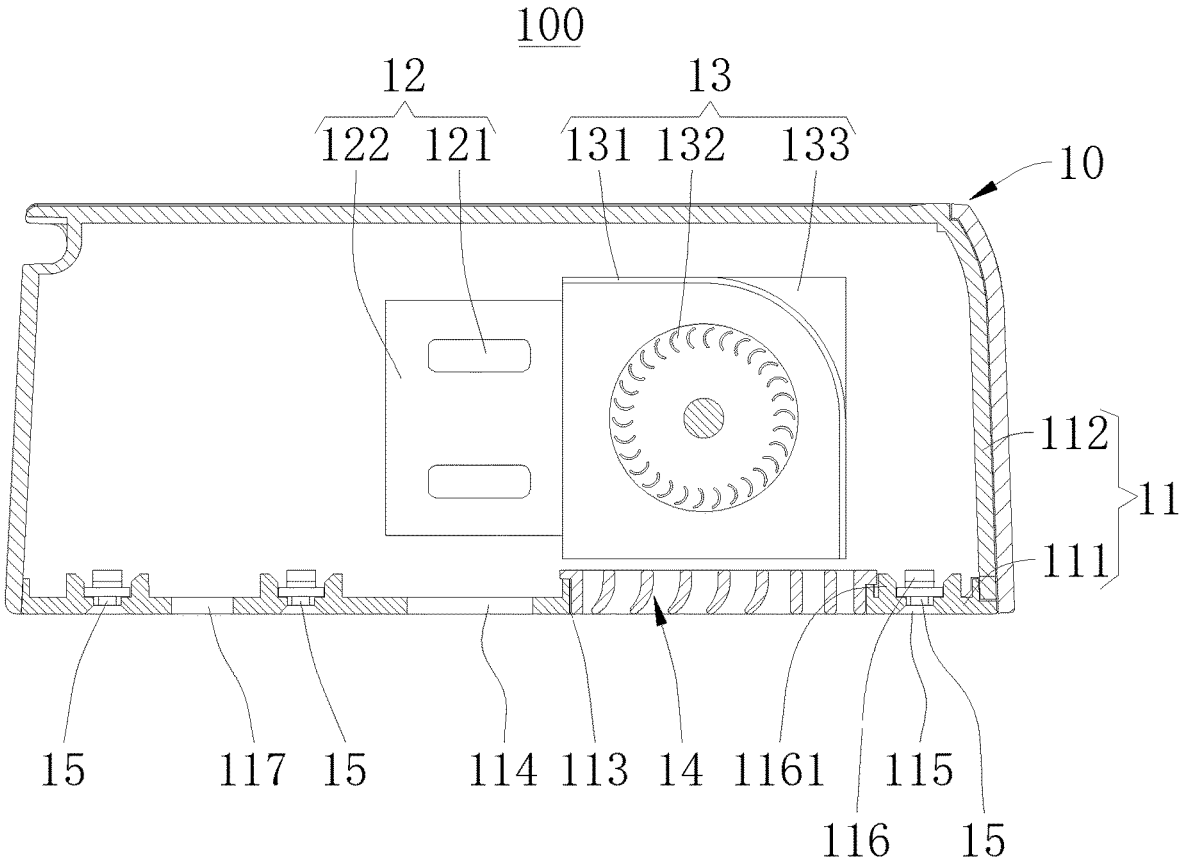
FIG. 15 is a sectional structure diagram of the main machine as shown in FIG. 14.

In an embodiment, please refer to FIG. 14 and FIG. 15, a plurality of ventholes 117 are arranged at the bottom of the shell 11, and the ventholes 117 are arranged near the ultraviolet LED modules 15 arranged at the side of the heater 12 far away from the fan housing 131, that is, the bottom of the shell 11 is provided with the plurality of ventholes 117 near the corresponding positions of the ultraviolet LED modules 15 arranged at the side of the heater 12 far away from the fan housing 131. Since the heater 12 is located at the inlet of the fan housing 131, and the ventholes 117 is arranged near the corresponding positions of the ultraviolet LED modules 15 arranged at the side of the heater 12 far away from the fan housing 131, then the air may be inhaled through the ventholes 117 while taking the heat generated by the adjacent ultraviolet LED modules 15 away together, and enter the heater 12 and then enter the fan housing 131, therefore, not only the heat dissipation is performed for the corresponding ultraviolet LED modules 15, but also this part of heat can be used to improve energy utilization so as to reduce energy consumption. Moreover, the heat generated by the ultraviolet LED modules 15 arranged close to the outlet of the fan housing 131 will also be taken away under the siphon effect of the fan housing 131 when the fan housing 131 blows air out so as to perform heat dissipation for the ultraviolet LED modules 15, and the heat generated by the ultraviolet LED modules 15 may be used to reduce energy consumption.

In an embodiment, please refer to FIGS. 14 and 15, the outlet of the fan housing 131 is located at a corresponding position near the front side of the shell 11, and the corresponding ventholes 117 are located near corresponding positions of the ultraviolet LED modules 15 arranged at the bottom of the shell 11 and arranged near the rear side of the shell 11. In some other embodiments, when the outlet of the fan housing 131 is located a corresponding position near the rear side of the shell 11, the corresponding ventholes 117 are located near corresponding positions of the ultraviolet LED modules 15 arranged at the bottom of the shell 11 and arranged near the front side of the shell 11.

The towel dryer 100 in the embodiments of the present application has the advantages of small volume, large air volume, large coverage area of hot air, low energy consumption, high energy utilization rate, long service life, simple structure and convenient assembly.

The above description has only described optional embodiments of the present application, and is not intended to limit the present application. Any modification, equivalent substitution and improvement made within the spirit and principle of the present application shall be included in the protection scope of the present application.

What is claimed is:

1. A towel dryer, comprising a main machine, wherein the main machine comprises a shell, a heater mounted in the shell and a fan mounted in the shell, an air outlet is arranged at a bottom of the shell corresponding to an outlet of the fan, and an air inlet is arranged at the bottom of the shell, and the heater is arranged on an airflow path of the fan, wherein the main machine further comprises a wind guide window mounted in the air outlet, and the wind guide window comprises a number of vertical air guide vanes with a transversal direction thereof being vertical to guide airflow to flow vertically downward and a number of inclined air guide vanes with a transversal direction thereof being oblique to guide the airflow to flow obliquely downward in a direction facing away from the vertical air guide vanes.

2. The towel dryer according to claim 1, wherein, a longitudinal direction of the vertical air guide vanes is parallel to a longitudinal direction of the inclined air guide vanes.

3. The towel dryer according to claim 2, wherein, each of the inclined air guide vanes is in a structure of a flat plate.

4. The towel dryer according to claim 2, wherein, each of the inclined air guide vanes comprises a bending section, and the bending section bends and extends from top to bottom in a direction facing away from the vertical air guide vanes.

5. The towel dryer according to claim 4, wherein, each of the inclined air guide vane further comprises a vertical section, and the bending section is connected with a lower end of the vertical section.

6. The towel dryer according to claim 1, wherein, both sides of an upper end of each of the vertical air guide vanes and each of the inclined air guide vane are arranged as rounded corners.

7. The towel dryer according to claim 1, wherein, the wind guide window further comprises a support frame, and the vertical air guide vanes and the inclined air guide vanes are fixedly connected with the support frame.

8. The towel dryer according to claim 1, wherein, the fan comprises a fan housing mounted in the shell, a tubular wind wheel mounted in the fan housing and a motor configured to drive the tubular wind wheel to rotate, an outlet of the fan housing is located at a position near a front side of the shell, and the vertical air guide vanes are located at one side of the inclined air guide vanes near the front side of the shell.

9. The towel dryer according to claim 1, wherein, the main machine further comprises an ultraviolet LED module mounted at the bottom of the shell.

10. The towel dryer according to claim 1, wherein, the main machine further comprises a lamp holder mounted in the shell and an ultraviolet lamp tube mounted on the lamp holder, and a window configured to expose the ultraviolet lamp tube is arranged at the bottom of the shell.

* * * * *